US005383100A

United States Patent [19]

Kikos

[11] Patent Number: 5,383,100

[45] Date of Patent: Jan. 17, 1995

[54] MULTI-CHANNEL TUBULAR DISPLAY PACKAGE

[76] Inventor: J. Peter Kikos, 1111 W. El Camino Real, Ste. 109, Sunnyvale, Calif. 94087

[21] Appl. No.: 739,885

[22] Filed: Aug. 2, 1991

[51] Int. Cl.[6] ..... F21K 2/00

[52] U.S. Cl. ..... 362/34; 362/84; 362/101; 362/104; 362/231; 362/318

[58] Field of Search ..... 362/32, 34, 101, 104, 362/231, 318, 320, 84, 260, 806; 385/125, 126

[56] References Cited

U.S. PATENT DOCUMENTS

| | | | |
|---|---|---|---|
| 1,107,725 | 8/1914 | Straubel | 362/318 |
| 1,614,004 | 1/1927 | Carbon | 362/318 |
| 3,740,113 | 6/1973 | Cass | 385/125 |
| 3,808,414 | 4/1974 | Roberts | 362/34 |
| 4,008,382 | 2/1977 | Nath | 385/125 |
| 4,772,986 | 9/1988 | McNemor | 362/34 |
| 4,828,349 | 5/1989 | Nakasuh | 385/126 |
| 4,973,129 | 11/1990 | Fukuzawa et al. | 385/126 |
| 4,978,377 | 12/1990 | Brehm et al. | 385/126 |
| 5,044,509 | 9/1991 | Petrosky et al. | 362/34 |

FOREIGN PATENT DOCUMENTS

| | | | |
|---|---|---|---|
| 342379 | 7/1964 | France | 362/318 |
| 245484 | 4/1912 | Germany | 362/318 |
| 441231 | 1/1936 | United Kingdom | 362/318 |

*Primary Examiner*—Richard R. Cole
*Attorney, Agent, or Firm*—Frost & Jacobs

[57] ABSTRACT

A flexible, light-transmissive, factory sealed, tubular display package having multiple channels which may rotate around or fluctuate parallel to the longitudinal axis of the package is disclosed. The channels may have coextruded linings and contain light-producing, luminescent materials, chemiluminescent materials, bioluminescent materials, fluorescent materials, colored dyes, liquid crystal materials, and the like to provide a multicolored display of the liquid products contained therein. When used with chemiluminescent compounds, the package finds particular application as jewelry, lightsticks, and in advertising exhibits.

46 Claims, 4 Drawing Sheets

MULTI-CHANNEL TUBULAR DISPLAY PACKAGE

A. BACKGROUND OF THE INVENTION

1. Field of the Invention

This invention relates to a novel tubular display package of the type comprising an elongated substantially solid light transmissive plastic tube having a plurality of closed ended channels formed longitudinally within the tube with a light affecting material contained within more than one of the channels. More particularly, the present invention relates to a multiplicity of intertwined helical channels for containing a luminescent product.

2. Description of Related Art

Various types of packages have been proposed for containing light-producing or light effecting materials. Generally, such packages comprise an elongated tube or tube-like container formed of plastic or other material which is sealed at both ends to create an interior volume for holding a quantity of the light affecting material. Such packages are often fabricated from extruded plastic. Among the wide variety of liquid products that may be contained in such tubular packaging is a range of luminescent, bioluminescent or chemiluminescent compositions.

One such form of tubular packaging has found application in chemical lightsticks of the type described in U.S. Pat. No. 3,576,987. In this type of arrangement, an outer flexible sealed tube contains components of a chemiluminescent mixture separated by a frangible glass vial inside the tube. By bending the tube, the frangible vial is broken, causing the components to mix and form a chemiluminescent mixture which emits light. The reaction transfers chemical energy to a fluorescer which will emit a characteristic wavelength of light in the range of 350–1000 nanometers. The art of generating colored light via chemical energy, by the reaction of an oxalic acid ester with hydrogen peroxide in the presence of a fluorescer compound in organic solvents has been disclosed in U.S. Pat. Nos. 3,816,326; 3,781,329; and 3,704,309. These types of chemical lightsticks find particular application as safety devices for use by persons under low-light conditions. Heretofore, however, all such lightstick applications have been limited to a single volume or channel within the chemical lightstick which produces but a single color.

Another typical, but by no means exclusive, application of luminescent tubular displays and their associated packaging is in connection with chemiluminescent jewelry. In these applications, chemical formulations of the type noted above are packaged as jewelry, e.g., necklaces, bracelets and earrings, to provide not only an attractive display, but also a wearable safety device for use by persons under low-light conditions. These types of wearable packages produce light with no external power source, emit no heat, and operate under all conditions, including in inclement weather and under water.

Generally, these products are fabricated from elongated flexible plastic tubing having an axially extending interior bore or channel. Numerous transparent dyes may also be embedded in the polymer matrix of the package shift the wavelength of the light, emitted or reflected light. Typical colorants which may be used in the present invention have a spectural emission falling between 330–1000 nanometers. Many fluorescent compounds having these properties are fully described in

*Fluorescence and Phosphorescence* by Peter Pringsheim, Interscience Publishers, Inc., New York, New York, 1949. One commercial embodiment of such a product has been marketed under the name NECKLITES by World Plastic Corp., Cincinnati, Ohio.

Generally, light activation in the above-noted types of devices is of two basic types. In one type, a frangible glass ampule contains one component of the chemiluminescent system, with the remaining component of the chemiluminescent system being contained within the single channel inside the tube. When the ampule is broken, as by bending the tube, the chemiluminescent materials mix together producing visible light as described above. A second approach premixes the chemiluminescent materials, but maintains the tubular packaging at a very low temperature by means of dry ice or the like to inhibit the chemical reaction until the display is used. Typical examples of these types of containers are described in U.S. Pat. Nos. 4,508,642 and 4,061,910. Heretofore, the present art of packaging such chemiluminescent formulations has been confined to displaying only one visible color per container. In order to produce multiple color effects, it has been necessary for the user to purchase multiple tubes of different colors and link them together, for example in a "daisy chain" using red, white and blue for Fourth of July events. Consequently, a need has existed for a self-contained tubular display package which is capable of producing multiple optical effects, such as different colors.

Another problem encountered in some prior art light emitting tubular packages is caused by the fairly thin 1.59 mm. (1/16 inch) interior diameter of the tubular packaging. Because of the relatively small interior diameter, the amount of luminescent liquid contained within the package is limited, thereby achieving a relatively low light level. The limited light output of this type of packaging has created a strong demand for larger diameter tubing in order to achieve higher light output, but the costs of doubling the inside diameter of the tubing, for example, results in an exponential increase in the quantity and thus the resulting cost of the luminescent liquid needed to fill the package. The disposable nature of this type of luminescent system, however, does not provide sufficient support in the marketplace for such exponential increases in the cost of the materials associated with this type of product. Although a type of display package called a "Jumbo" necklace has shown the demand for larger diameter products, the market has been limited by the cost of the luminescent liquid necessary to fill this size package.

Consequently, a need exists for a tubular display package capable of producing multiple optical effects, and in particular a display which can produce two or more visually discernable colors from the same package. Further, a need exists for a tubular display package which can produce a greater light output, particularly for use under low light conditions, without a disproportionately large increase in the amount of luminescent liquid required. From the detailed description which follows, it will become clear that to advance the state-of-the-art, it is necessary that the types of extruded tubular packages described herein have multiple internal channels. It will further become apparent that the position, volume and number of these channels have the capability of varying independently within the package.

Finally, while the state-of-the-art, as well as exemplary applications of the present invention, are described herein in connection with lightsticks and jewelry, it will be understood that the improvements contemplated by the present invention may be incorporated in any light transmissive tubular package to exhibit the light affecting materials within multiple channels incorporated in the package.

B. SUMMARY OF THE INVENTION

While not exclusive, the following describes some of the important features and objectives of the present invention.

It is an object of the present invention to provide a novel flexible light transmissive tubular display package for exhibiting the contents of one or more materials contained within a multiplicity of longitudinally extending channels within the tubular package.

It is a further object of the present invention to provide a novel tubular display package having a multiplicity of longitudinally extending channels there within for containing luminescent materials distinctly visible through the walls of the container.

It is a further object of the present invention to provide a novel device for displaying multiple colors or types of liquid in the same tubular package simultaneously.

It is a further object of the present invention to provide a novel package for displaying one or more types of liquid contained within a multiplicity of helically intertwined channels within a single light transmissive tube.

It is a further object of the present invention to provide a novel tubular display package comprising an elongated substantially solid light transmitting plastic tube including a plurality of channels extending longitudinally within the tube, in which a fluorescent dye is coextruded in a thin lining on the surface of at least one of the channels, and wherein the dye shifts the wavelength of light produced by a luminescent material within the channel.

It is a further object of the present invention to provide a novel tubular display package comprising an elongated substantially solid light transmitting plastic tube with a plurality of channels extending longitudinally within the tube, a frangible tube positioned within at least one of the channels with the frangible tube containing one component of a luminescent light system, the luminescent component mixing with a second luminescent component contained within the channel when the frangible tube is broken to produce light.

It is a further object of the present invention to provide a novel tubular display package comprising a substantially solid light transmitting plastic tube with a plurality of channels extending longitudinally within the tube and a material different from the plastic material forming the tube coextruded on the surface of one of the channels.

It is a further object of the present invention to provide a novel method for displaying luminescent products in which the light output can be adjusted through the configuration and positioning of a multiplicity of longitudinally extending channels containing a light producing material within the tubular display package.

It is a further object of the present invention to provide a tubular display package whose cross-section has one or more straight sides.

It is a further object of the present invention to provide a novel tubular display package of the type described which can be used in advertising and trade show exhibits.

It is a further object of the present invention to provide a novel tubular display package of the type described which can be worn as jewelry.

The foregoing objects can be accomplished by providing a substantially solid flexible sealed light transmissive tube with multiple channels extending the length of the package which can be independently filled with separate luminescent liquids of different colors. In the preferred embodiment of the invention, one or more of the channels are rotated around the axis of the tubing to create a multiple helix within the body of the tubing so as to provide a unique and novel method of economically increasing the light output of the package.

C. BRIEF DESCRIPTION OF THE DRAWINGS

While the specification concludes with claims particularly pointing out and distinctly claiming the present invention, it is believed the same will be better understood from the following description taken in conjunction with the accompanying drawing in which:

D. DESCRIPTION OF THE PREFERRED EMBODIMENT

Figure 1:
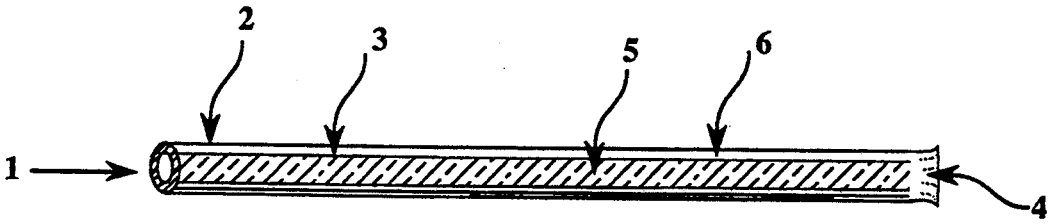
Figure 1 (Prior Art)
FIG. 1 is a fragmentary partially cross-sectional front view of a prior art tubular display package having a single interior channel.

FIG. 1 illustrates a conventional prior art tubular display package 1 formed from an elongated flexible plastic tube 2 of indefinite length. Plastic tube 2 is provided with a longitudinally extending interior bore or channel 3 which, in the finished package, will be closed or sealed at both ends as at 4 to create a closed interior volume comprising channel 3. It will be understood that for purposes of clarity only one end of tube 2 is shown closed in FIG. 1. The channel 3 contains a luminescent material 5 of the type described hereinabove which emits light at a particular wavelength. A fluorescent dye 6 may be incorporated in the wall of tube 2 to shift the wavelength of the light produced by the luminescent material 5 within channel 3. Tubular display package 1 may be provided in an indefinite length to form a lightstick as described hereinabove, or formed into closed loops to be worn as personal adornments such as necklaces, bracelets, earrings and the like as is well-known in the art. However, it will be understood that the references herein to exemplary forms of tubular containers such as lightsticks or luminescent jewelry do not represent a limitation upon the present invention or its application to other types of tubular display packages. It will be further understood that the type of conventional tubular display package 1 exemplified herein contains only a single interior channel within the tubular container and produces discernable light of only one color.

Figure 2:
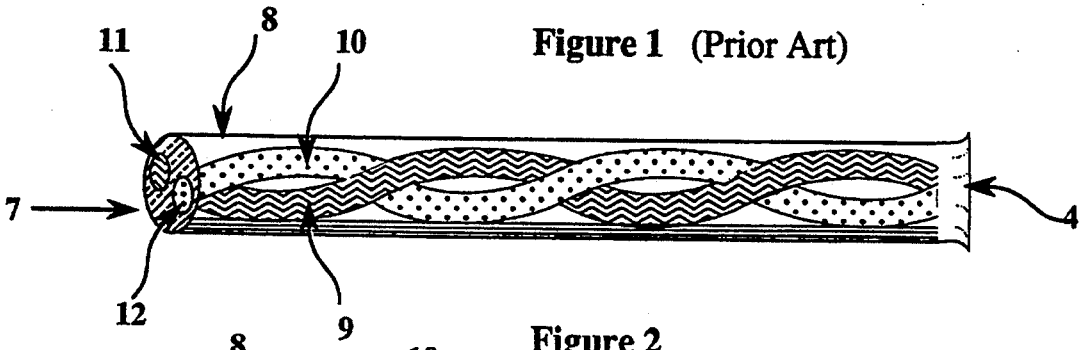
FIG. 2 is an enlarged fragmentary partially cross-sectional front elevational view of a portion of the tubular display package of the present invention.

FIG. 2 illustrates a first exemplary embodiment of a tubular display package 7 made in accordance with the teachings of the present invention. Tubular display package 7 is composed of a substantially solid light transmissive flexible plastic tube 8 of indefinite length. The plastic material forming tube 8 may be transparent or translucent. Tube 8 may be formed of any suitable plastic material chemically resistant to the light affecting materials contained within the tube as described hereinafter. Suitable plastic materials for tube 8, which may be formed by extrusion, include polyvinyl chloride, ethylene vinyl acetate, polyethylene, ethyl acrylate, ethylene methacrylic acid, polypropylene, Teflon and Tefezel, among others.

Contained within plastic tube 8 is a plurality of bores or channels formed and extending longitudinally within the tube. Generally, it is preferred that the channels be unconnected to each other at any point along their lengths. For purposes of an exemplary showing, the embodiment of FIG. 2 is illustrated with two such unconnected channels, a first channel 9 and a second channel 10. However, as will become clear from the description hereinafter, tube 8 may be provided with more than two channels, as desired.

Tube 8 is sealed at both ends as at 4 (although only one such sealed end is shown in FIG. 2) in order to form closed-ended interior volumes comprising channels 9 and 10, respectively. The ends of tube 8, and hence channels 9 and 10, may be closed by any conventional means such as sealing, adhesives, plugs, or the like. It will be understood that the ends of tube 8 are permanently or factory sealed so that the package cannot be opened by the user under normal use. The resulting configuration thus forms a package containing materials which can be observed through the walls of the light transmissive tube 4. As will become apparent herein, the user of these types of products can thus benefit from the contents of the packages without actually accessing the light affecting materials they contain.

In the embodiment illustrated in FIG. 2, each of channels 9 and 10 is partially or completely filled with a light affecting material, which can be in the form of a liquid, powder, solid, or other form. As used herein, "light affecting material" means any material having the capability of producing a visual or optical effect, and includes, but is not limited, to a luminescent material, a chemiluminescent material, separate component materials that when mixed together produce light, a bioluminescent material, a fluorescent material, a colored dye, a liquid crystal material, or combinations of the foregoing.

In the particular embodiment illustrated in FIG. 2, each of channels 9 and 10 may be filled with a different light affecting material which produces visually distinguishable effects, such as different colors. In other words, first channel 9 may contain, for example, a luminescent material 11 producing light at a first wavelength (i.e., a first color), and second channel 10 may contain a luminescent material 12 producing light at a wavelength different from the first wavelength (i.e., a different color). Alternatively, first channel 9 and second channel 10 may be partially or completely filled with the same or different light affecting materials for increasing the light output from the tubular display package, as will be described in more detail hereinafter. In either event, the effects of the light affecting material or materials contained within the multiplicity of longitudinally extending channels within tube 8 can be visually discerned by the user.

The multiple channels within tube 8 may be physically positioned with respect to each other in various ways. For example, in the embodiment illustrated in FIG. 2, each of first channel 9 and second channel 10 is helically shaped. The channels are positioned at equal distances from the longitudinal axis of the package. It will be understood, however, that no precise mathematical relationship is intended as to either the shape of the helical channels or their positioning with respect to each other by the use of the general term "helical." Rather, in the exemplary embodiment of FIG. 2, channels 9 and 10 may form separate side-by-side helices, or may be intermeshed, twisted, or intertwined with each other in any fashion so as to produce the desired visual effect.

It will be understood that the helical shape of channels 9 and 10 in the exemplary embodiment of FIG. 2 may also be configured in different ways. For example, the turns comprising the helical shape of either or both of the channels may occur at regular or irregular intervals. Further, as illustrated in the embodiment of FIG. 2, the turns of the helical-shaped channels may occur at the same regular or irregular intervals, and may be displaced by any appropriate distance along the axis of tube 8. Alternatively, although not illustrated, the turns of one of the helical-shaped channels may occur at regular intervals, while the turns of the other helical-shaped channel may occur at irregular intervals.

Figure 3:
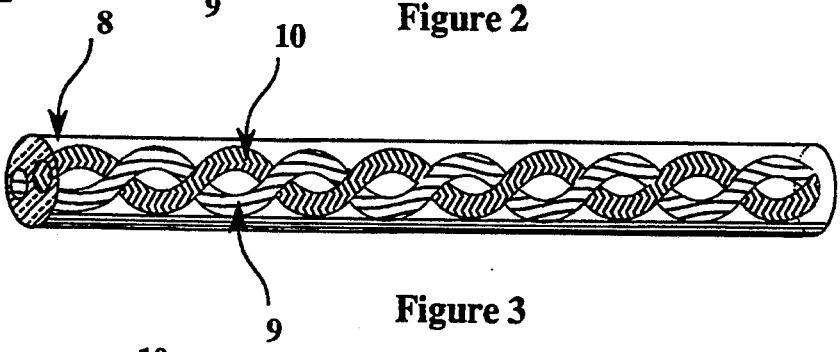
FIG. 3 is an enlarged partially cross-sectional front elevational view of a modification to the tubular display package illustrated in FIG. 2.

Also, channels 9 and 10 may be configured with any desired spacing between turns of the helical shape by varying the rotational angle of the channels along the longitudinal axis of the package. For example, as illustrated in the exemplary embodiment of FIG. 3, channels 9 and 10 are provided with the same distance between adjacent turns. However, such distance between adjacent turns is shorter than the distance between adjacent turns of the helical-shaped channel used in the embodiment of FIG. 2. Thus, channels 9 and 10 may be intertwined in a relatively loose configuration as illustrated in FIG. 2, or in a tighter configuration, i.e., more twists per unit length, as illustrated in FIG. 3. Consequently, the number of turns per unit length of the helical-shaped channels may be varied as desired to achieve a particular visual effect. For example, although not intended to constitute a limitation on the present invention, the rotational angle of one or both of the helically-shaped channels can be continuously varied so as to produce a helically-shaped channel whose size or shape varies along the length of tube 8.

Figure 4:
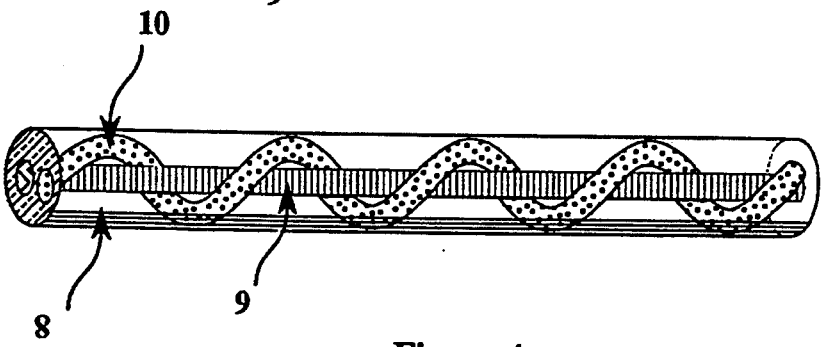
FIG. 4 is a fragmentary partially cross-sectional front elevational view of a further modification of the embodiment of FIG. 2.

Alternatively, as illustrated in FIG. 4, channels 9 and 10 may be positioned at any desired distance from the central axis of tube 8. For example, as shown in FIG. 4, channel 9 may be positioned on the central axis of tube 8, while channel 10 is located near the outer edge of the tube. This permits a display package to be manufactured in which the channels lie at different distances from the surface of tube 8 so as to provide selectable visual effects. For example, the type of package illustrated in FIG. 4 permits luminescent materials with greatly different light yields to be used together in such a way that the luminescent material with greater light output will not overwhelm that with a lower light output. Moreover, by varying the distance from the longitudinal axis of the package, it will also permit the volumes of each of the channels to be varied, thereby allowing use of a greater or lesser amount of luminescent material within the channel. It will be understood the distance of the channel from the longitudinal axis may be fixed, or varied as desired along the length of tube 8. Thus, this type of arrangement permits the light affecting qualities of the materials within each of the channels to be balanced or otherwise adjusted with respect to each other in order to vary the optical effects produced by the display package. Further, it will be understood to be within the scope of the present invention to simultaneously vary the rotational angle of the channel as well as the distance of the channel from the longitudinal axis of the tube.

Figure 5:
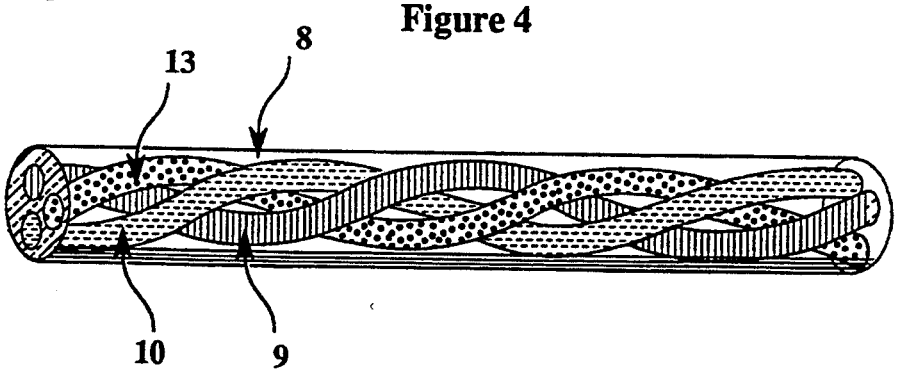
FIG. 5 is a fragmentary partially cross-sectional front elevational view of an embodiment of the present invention utilizing three helically intertwined channels.

FIG. 5 illustrates another arrangement wherein three longitudinally extending channels 9, 10 and 13 may be helically intertwined with each other or configured in some other physical relationship to provide a desired optical or visual effect. It will be understood that each of channels 9, 10 and 13 may be partially or completely filled with a suitable light affecting material, as described hereinabove.

Figure 6A:
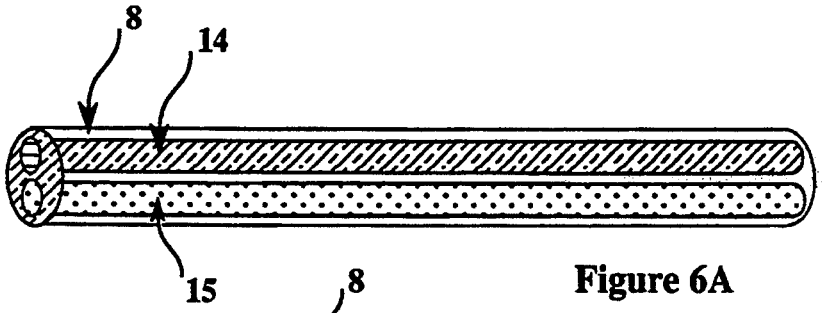
FIG. 6A is a fragmentary partially cross-sectional top plan view of an embodiment of the present invention using parallel extending sinuously-shaped channels.
Figure 6B:
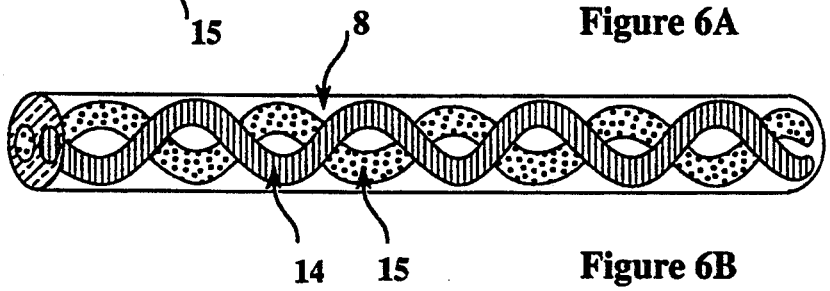
FIG. 6B is a fragmentary partially cross-sectional side elevational view of the embodiment of FIG. 6A.

FIG. 6A and FIG. 6B illustrate another embodiment in which channels 14 and 15 are made to undulate or fluctuate parallel to the longitudinal axis within tube 8. As in the foregoing embodiments, each of channels 14 and 15 may contain a light affecting material. Thus, when viewed from the top as in FIG. 6A, the light affecting materials within channels 14 and 15 appear to produce parallel extending lines or strips. However, when the tube is viewed from the side as in FIG. 6B, the materials in channels 14 and 15 appear to produce a wavy or sinuously-shaped pattern. In the particular embodiment illustrated, the wavy-shaped channels 14 and 15 are positioned so as to be about 180° out of phase. However, it will be understood that the relative positioning between the channels may be varied as desired. Further, one of the channels may also have more or less undulations per unit length than the other channel.

Figure 13A:
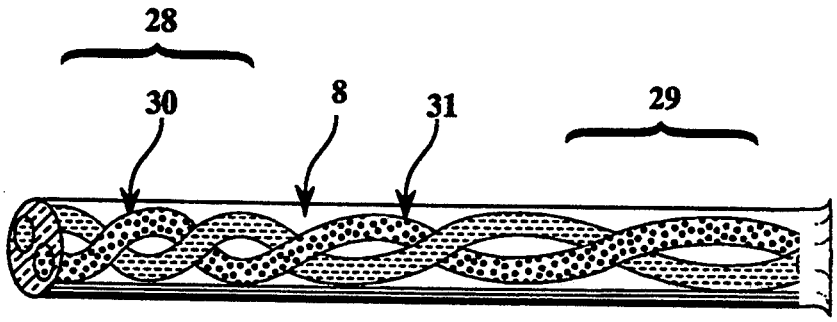
FIG. 13A is a fragmentary partially cross-sectional front elevational view of an embodiment of the present invention utilizing two helically intertwined channels in which the channels exhibit a varying rotational angle.

FIG. 13A depicts an embodiment of the present invention in which channels 30 and 31 exhibit a varying rotational angle. In addition, channels 30 and 31 have a different number of turns per unit length along the longitudinal axis of tube 8, as can be easily viewed by comparing the frequency of turns at the location designated by index numeral 28 to the frequency of turns at the location designated by index numeral 29.

Figure 13B:
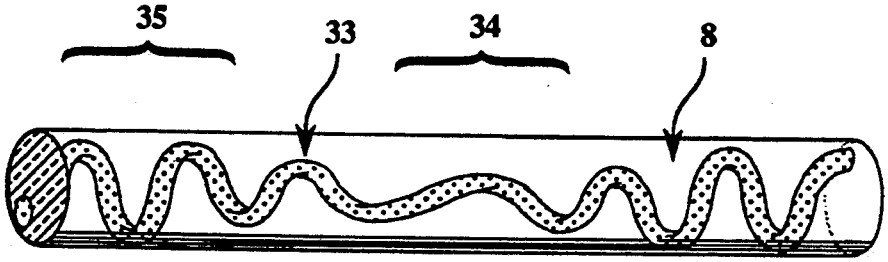
FIG. 13B is a fragmentary partially cross-sectional front elevational view of an embodiment of the present invention utilizing a channel which exhibits a varying distance from central longitudinal axis.

FIG. 13B depicts an embodiment in which the sole channel 33 exhibits a varying distance from the central longitudinal axis of tube 8. The frequency or number of turns per unit length need not vary to construct the embodiment of FIG. 13B. The distance of channel 33 from the longitudinal axis at the location designated by index numeral 35 is easily discerned as being different from its distance at the location designated by index numeral 34. It will be understood that two or more similar channels could be included in tube 8, each having a varying or different distance from the longitudinal axis; and in particular, one such channel could be closely spaced from the longitudinal axis at the same location along the length of tube 8 at which a second channel could be remotely spaced from the longitudinal axis. Such variable geometry of multiple channels is virtually limitless, and could be used to create unusual visual effects.

Figure 13C:
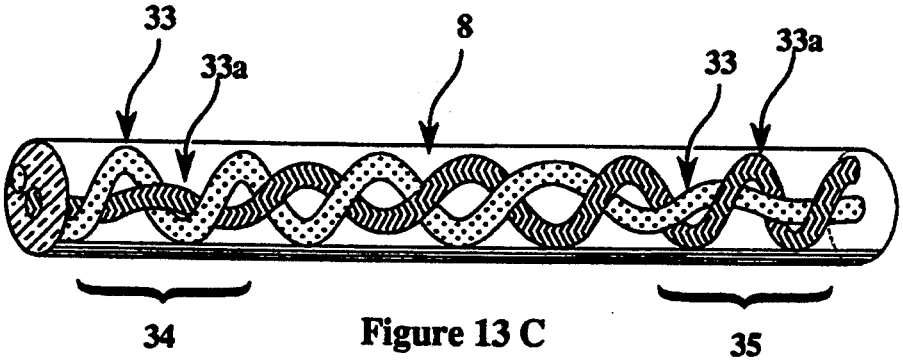
FIG. 13C is a fragmentary partially cross-sectional front elevational view of an embodiment of the present invention utilizing two helically intertwined channels in which the channels exhibit a varying distance from central longitudinal axis.

FIG. 13C depicts an embodiment in which channels 33 and **33*a* exhibit a varying distance from the central longitudinal axis of tube 8. The frequency or number of turns per unit length need not vary to construct the embodiment of FIG. 13C. The distance of channels 33 and 33*a* from the longitudinal axis at the location designated by index numeral 35 is easily discerned as being different from their distance at the location designated by index numeral 34. It will be understood that more than two similar channels could be included in tube 8, each having a varying or different distance from the longitudinal axis; and in particular, one such channel could be closely spaced from the longitudinal axis at the same location along the length of tube 8** at which a second channel could be remotely spaced from the longitudinal axis. Such variable geometry of multiple channels is virtually limitless, and could be used to create unusual visual effects.

Figure 7:
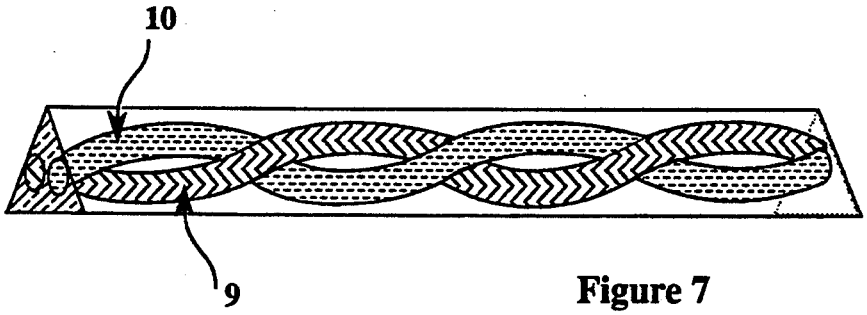
FIG. 7 is a fragmentary partially cross-sectional perspective view of an embodiment of the present invention utilizing a triangular tubular display package.

Although for purposes of an exemplary showing, the channels described herein have been shown and described with circular cross-sections, it will be understood that any desired circular or non-circular cross-sectional shape may be utilized including, but not limited to, elliptical or polygonal. It will further be understood that the cross-sectional shape of tube 8 may be circular as described hereinabove, or may be formed in any other non-circular geometrical shape. Although not to be considered a limitation on the present invention, the outer surface of tube 8 may be provided with one or more flat sides, such as the triangular configuration illustrated in FIG. 7. The external geometry of tube 8 is thus deemed to be limited only by the number of flat sides that can be extruded or formed on the surface of tube 8. Finally, although not a limitation on the possible applications of the present invention, it will be understood that the length of the tubular display may be relatively short for use in lightsticks or personal adornments or jewelry such as earrings, bracelets, necklaces and the like, or may be provided in indefinite lengths (e.g., 500 foot spools) for use in advertising or trade displays.

One of the numerous advantages of the present invention is that light output from the display package can be increased without an unnecessary large increase in the amount of material used. For example, if additional output from a tubular display package is desired using the same light affecting material, it is generally necessary to increase the surface area of the interior channel of the display by a corresponding amount. Conventional methods of packaging have been limited to increasing the diameter of the channel, which exponentially increases the volume of material needed to fill the tube. For example, to double the surface area of the channel, and consequently the light affecting ability, it is generally necessary to double the diameter of the interior channel. This increase, however, results in a quadrupling of the interior volume of the channel and the amount of light emitting material needed to fill it, which translates into a 400% increase in material costs. To date, economies of scale have prevented anything more than prototype production of these larger diameter tubes because of the high manufacturing costs associated with the production of luminescent compounds.

With the present invention, the use of such large volume interior channels is unnecessary. An equivalent light producing effect can be achieved by using a multiplicity of smaller interior channels, rather than a single larger channel. In other words, in the embodiments described herein of the present invention, there can be obtained a doubling of the total surface area of the channels and a corresponding doubling of the display's light affecting ability, with only a twofold increase in the interior volume. Consequently, only half as much material need be utilized as in conventional approaches, resulting in significant cost savings.

Figure 8:
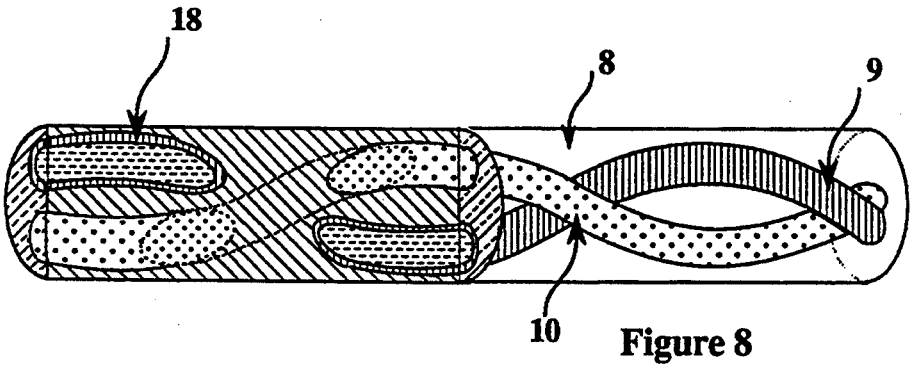
FIG. 8 is a fragmentary partially cross-sectional front elevational view of an embodiment of the present invention utilizing channels having coextruded linings.

Tube 8 may also be provided with a variety of fluorescent dyes or pigments to shift the wavelength of the light emitted or reflected from the materials within the channels. Thus, in one embodiment, the material produces a light at a first wavelength, and the fluorescent dye or pigment produces light at a wavelength different from the first wavelength when exposed to the light from the material within the channel. To achieve this result, a fluorescent dye or pigment may be embedded or incorporated in the wall of the tube 8. Alternatively, as illustrated in FIG. 8, one or both of the channels 9 or 10 may be provided on its surface with a thin lining 18 of a fluorescent dye or pigment. Consequently, in an application where light producing materials are utilized within one or more of the channels, the light produced by the material within channel 10 will appear as one color, while the light produced by the lining of dye or fluorescent material 18 associated with channel 9 will appear as a different color. Thus the tubular display will exhibit two visually distinguishable colors. Alternatively, a fluorescent dye of one type may be embedded or incorporated in the wall of tube 8, while a fluorescent dye of a different type may form the lining 18 of one of the interior channels. Thus, even though both interior channels contain the same material, the tube itself will appear as one color, while the channel containing the thin lining of dye or fluorescent material will appear as a different color, thus producing a unique optical effect. For purposes of manufacturing the tubular display just described, it will be understood that the tube 8 and the lining of dye or fluorescent material 18 may be coextruded, that is extruded at substantially the same time.

Figure 9:
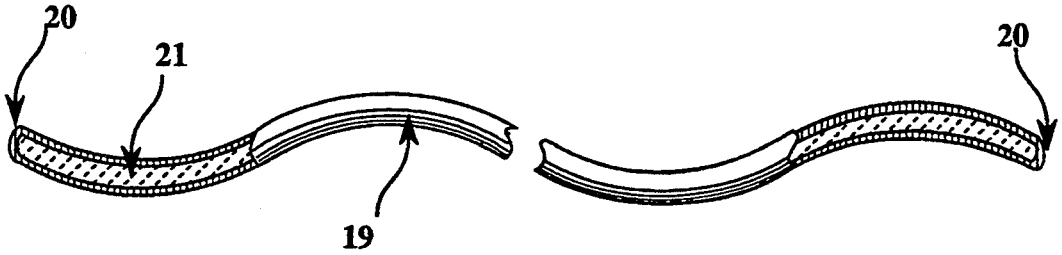
FIG. 9 is a fragmentary cutaway partially cross-sectional front elevational view of an embodiment of a helically-shaped ampule for use in the self-activated tubular display package.

The principles of the present invention may also be applied to a tubular display package which is activated by the user to produce the desired optical effect. FIG. 9 shows an elongated frangible tube-like helical-shaped hollow ampule 19 dimensioned and configured to fit within one of the helical channels of tube 8. The ends of ampule 19 are closed as at 20 to form an interior space 21 for containing one of the components of a chemiluminescent light producing system. The ampule 19 is dimensioned so as to permit a space to exist within the channel between the outer surface of the ampule and the surface of the channel. This space will be partially or completely filled with a second component associated with a chemiluminescent system.

Figure 10:
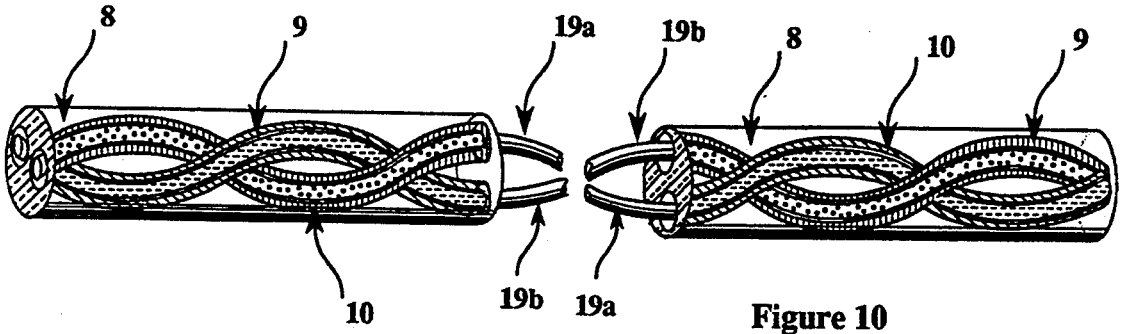
FIG. 10 is a fragmentary cutaway partially cross-sectional front elevational view of an assembled self-activated tubular display package using the ampule of FIG. 9.

As illustrated in FIG. 10, ampules 19*a* and 19*b* having the construction of ampule 19 in FIG. 9 have been inserted into channels 9 and 10, respectively, of tube 8. Channels 9 and 10 each contain a second component associated with a chemiluminescent system within the space surrounding the respective ampules 19*a* and 19*b*.

Figure 11:
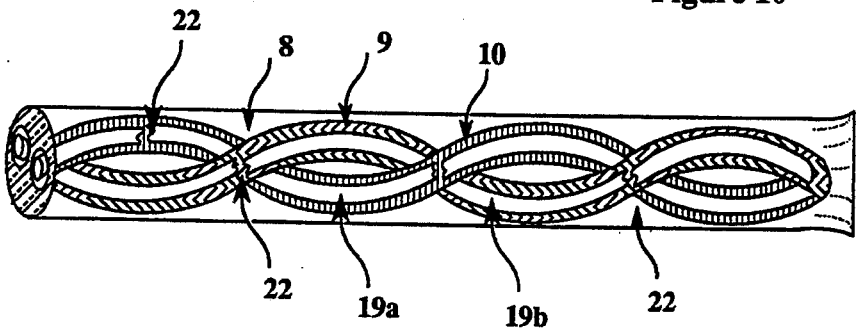
FIG. 11 is a fragmentary partially cross-sectional front elevational view illustrating activation of the tubular display of FIG. 10.

In FIG. 11, tube 8 has been flexed sufficiently to fracture ampules 19*a* and 19*b* at one or more points 22. This permits the chemiluminescent components within ampule 19*a* and channel 9, and within ampule 19*b* and channel 10, to mix together to produce light. It will be understood in accordance with the foregoing description that the chemiluminescent materials may be chosen to produce different colors from channels 9 and 10, or that only one of channels 9 or 10 may be provided with a frangible ampule 19*a* or 19*b*.

As noted hereinabove, the plastic material forming tube 8 is chosen so as to be resistive to the chemical action of the material contained within the channel. However, it may be found that a particular plastic chosen for its optical qualities may be chemically incompatible with the material contained within the channel. In this case, a thin lining of chemically resistant plastic material different from the plastic material comprising the tube may be provided on the surface of the channel in the same manner as that described hereinabove with respect to the thin lining of fluorescent dye 8 of the embodiment of FIG. 8. Further, the thin lining of plastic material may be coextruded with the material of the tube itself. For example, the tube material may comprise polyvinyl chloride, while the thin layer of plastic material may comprise ethylene vinyl acetate, polyethylene, ethylene methacrylic acid, ethyl acrylate, Teflon, Tefezel, or the like.

Figure 12:
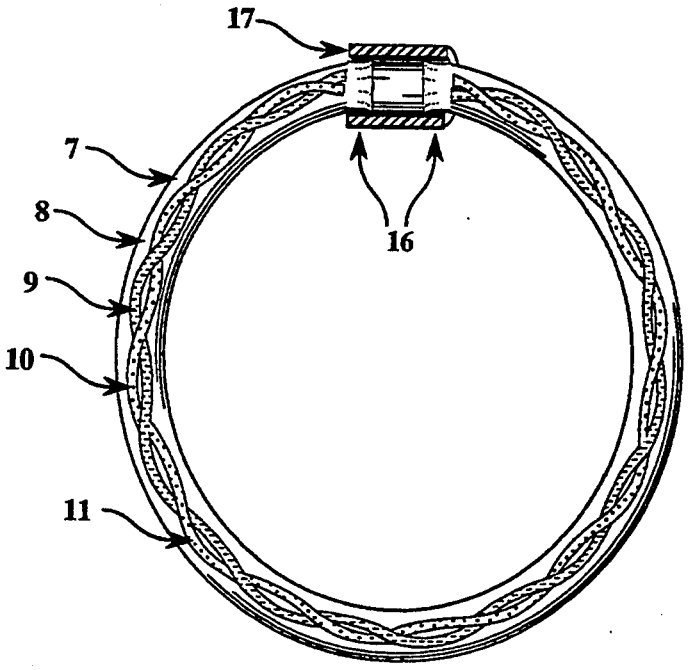
FIG. 12 is a partially cross-sectional front elevational view of an exemplary embodiment of a light emitting wearable package made in accordance with the present invention.

It will be understood that the principles described hereinabove may be applied to various applications. For purposes of an exemplary showing, and without limiting the applicability of the present invention, FIG. 12 illustrates the principles of the present invention embodied in a personal adornment such as a necklace or bracelet. In this application, tube 8 has been formed in a generally closed loop. The ends 16 of tube 8 are sealed by any conventional means such as heat sealing, compression, plugs, or the like. The sealed ends are then permanently or removably joined together by a short hollow piece of tubing 17 forming a friction connector, as is well known in the art. Although for purposes of an exemplary showing, a friction connector has been described and illustrated, it will be understood to be within the scope of the present invention to utilize other means for connecting together the ends of the tube to form a generally closed loop of the appropriately desired size.

In the embodiment of FIG. 12, the interior of tube 8 is provided with channels 9 and 10 which are helically intertwined as previously described. Each of channels 9 and 10 may be partially or completely filled with a material, and in particular luminescent materials producing different colors. Thus, when the luminescent materials are activated, as described hereinabove, the different colors produced by the luminescent materials within channels 9 and 10 will appear to produce alternating bands of different colors as viewed through the walls of tube 8.

It will be understood that modifications may be made in the invention without departing from the spirit of it.

I claim:

1. A tubular display package comprising an elongated substantially solid light transmitting plastic tube, said tube having a longitudinal axis and a radial axis, and a plurality of side-by-side channels formed and extending longitudinally within said tube, said channels being permanently closed at their ends to form an interior volume for containing a light affecting material within said channels, said plastic tube completely surrounding said channels to form a plurality of light paths along said radial axis substantially throughout its longitudinal axis, wherein said channels comprise means to emit light predominately in the radial direction.

2. The package according to claim 1 wherein said plastic tube material is chosen from the group consisting of polyvinyl chloride, ethylene vinyl acetate, polyethylene, ethyl acrylate, ethylene methacrylic acid, polypropylene, Teflon and Tefezel.

3. The package according to claim 1 wherein said tube is flexible.

4. The package according to claim 1 wherein at least one of said channels is non-linear.

5. The package according to claim 1 wherein at least one of said channels fluctuates parallel to the longitudinal axis of the tube.

6. The package according to claim 5 wherein said fluctuations vary along the longitudinal axis of said tube.

7. The package according to claim 1 wherein at least one of said channels is helically shaped and exhibits a rotational angle with respect to said longitudinal axis.

8. The package according to claim 7 wherein the rotational angle of said helically shaped channel varies along the longitudinal axis of said tube.

9. The package according to claim 7 wherein the distance from the longitudinal axis of said tube of said helically shaped channel varies along the longitudinal axis of said tube.

10. The package according to claim 1 wherein said channels enclose different volumes.

11. The package according to claim 1 wherein one or more of said channels is rotated about the longitudinal axis of said tube.

12. The package according to claim 1 including two or more of said channels which are helically intertwined with each other, and each said channel exhibits a rotational angle with respect to said longitudinal axis.

13. The package according to claim 12 wherein the rotational angle of at least some of said helically intertwined channels have a different number of turns per unit length, as compared to adjacent channels.

14. The package according to claim 12 wherein at least some of said helically intertwined channels are spaced at different distances from the longitudinal axis of said tube, as compared to adjacent channels.

15. The package according to claim 1 including at least three of said channels which are helically intertwined with each other.

16. The package according to claim 1 wherein said light affecting material comprises a light producing luminescent material.

17. The package according to claim 1 wherein said light affecting material comprises a fluorescent material.

18. The package according to claim 1 wherein said light affecting material comprises a colored dye.

19. The package according to claim 1 wherein said light affecting material comprises a liquid crystal material.

20. The package according to claim 1 wherein at least some of said channels contain light affecting materials producing visually distinguishable effects.

21. The package according to claim 20 wherein said light affecting materials produce different colors.

22. The package according to claim 1 wherein said channels comprise first and second channels, said first channel containing a luminescent material for producing light at a first wavelength, said second channel containing a luminescent material for producing light at a wavelength different from said first wavelength.

23. The package according to claim 1 including means allowing said tube to be worn as a personal adornment.

24. The package according to claim 23 wherein said means comprises means for connecting together the ends of said tube so as to form a loop to enable the personal adornment to be worn as a necklace or bracelet.

25. The package according to claim 1 including a light affecting material comprising a first material producing light at a first wavelength, said tube including a second material associated therewith for producing light at a wavelength different from said first wavelength when exposed to the light from said first material.

26. The package according to claim 25 wherein said second material is embedded in said tube.

27. The package according to claim 25 wherein said second material is provided in a thin lining on the surface of said channel.

28. The package according to claim 27 wherein said tube and said second material are coextruded.

29. The package according to claim 1 including a first light affecting material contained within a first one of said channels and a frangible tube positioned within said first channel, said frangible tube containing a second light affecting material, said first and second light affecting materials mixing together to produce light when said frangible tube is broken.

30. The package according to claim 1 including a first light affecting material contained within a first one of said channels and a frangible ampule positioned within said first channel, said first light affecting material being contained within said channel outside of said ampule, and a second light affecting material contained within said ampule, said first and second light affecting materials mixing together to produce light when said ampule is ruptured.

31. The package according to claim 1 including a thin lining of a plastic material different from the plastic material comprising said tube formed on the outer surface of said channel.

32. The package according to claim 31 wherein said tube and said different plastic material are coextruded.

33. The package according to claim 31 wherein said tube material comprises PVC and said thin lining of material is chosen from the group consisting of ethylene vinyl acetate, polyethylene, ethyl acrylate, ethylene methacrylic acid, Teflon, and Tefezel.

34. The package according to claim 1 wherein at least some of said channels enclose different volumes.

35. The package according to claim 1 wherein said channels are non-circular in cross section.

36. The package according to claim 1 wherein said tube is provided with at least one straight side.

37. A tubular display comprising an elongated substantially solid flexible light transmitting plastic tube having first and second helically intertwined channels formed and extending longitudinally within said tube, a luminescent material for producing light at a first wavelength contained within said first channel, and a luminescent material for producing light at a wavelength different from said first wavelength contained in said second channel, whereby the light produced within each of said channels is distinguishable through the walls of said tube.

38. The display according to claim 37 including means for connecting together the ends of said tube so as to form a loop to enable the display to be worn as a necklace or bracelet.

39. The display according to claim 37 including a thin lining of a plastic material different from the plastic material comprising said tube formed on the outer surface of said channel.

40. The display according to claim 37 including a fluorescent dye incorporated within said tube, said dye, when exposed to light from said luminescent material, producing light at a wavelength different from the wavelength of light produced by said luminescent material.

41. The display according to claim 40 wherein said fluorescent dye is provided in a thin lining on the surface of said channel.

42. The display according to claim 41 wherein said tube and said fluorescent dye are coextruded.

43. The display according to claim 37 wherein said luminescent material is contained within a first one of said channels and a frangible tube positioned within said first channel, said frangible tube containing a second luminescent material, said luminescent materials mixing together within said first channel to produce light when said frangible tube is broken.

44. The display according to claim 37 wherein at least some of said helically intertwined channels have a different number of turns per unit length, as compared to adjacent channels, for adjusting the apparent relative amount of light produced by the luminescent materials within said first and second channels.

45. The display according to claim 37 wherein said helically intertwined channels are spaced at different distances from the longitudinal axis of said tube, as compared to adjacent channels, for adjusting the apparent relative amount of light produced by the luminescent materials within said first and second channels.

46. The display according to claim 37 wherein said tube is provided with at least one flat side.

* * * * *